United States Patent [19]

Kane

[11] Patent Number: 4,545,615

[45] Date of Patent: Oct. 8, 1985

[54] FURNITURE CONSTRUCTION WITH REPLACEABLE ELASTOMERIC COVERING

[75] Inventor: Brian J. Kane, San Francisco, Calif.

[73] Assignee: Metropolitan Furniture Corp., San Francisco, Calif.

[21] Appl. No.: 529,618

[22] Filed: Sep. 6, 1983

[51] Int. Cl.[4] ..... A47C 3/00

[52] U.S. Cl. ..... 297/287; 297/294; 297/445; 297/418

[58] Field of Search ..... 297/445, 447, 448, 419, 297/420, 294, 287

[56] References Cited

U.S. PATENT DOCUMENTS

| | | | |
|---|---|---|---|
| D. 143,982 | 2/1946 | Michelson | 297/447 X |
| D. 174,472 | 4/1955 | Roth | 297/447 |
| 1,791,453 | 2/1931 | Mies | 297/294 |
| 2,229,411 | 1/1941 | Hughes | 297/418 X |
| 2,656,878 | 10/1953 | Reinholz | 297/287 |
| 3,243,234 | 3/1966 | Fehlner | 297/445 X |
| 3,506,307 | 4/1970 | Kahle | 297/445 X |
| 3,601,176 | 8/1971 | Savickas | 297/445 |
| 3,784,254 | 1/1974 | Longato | 297/445 |
| 4,049,315 | 9/1977 | Jacobson | 297/447 |
| 4,361,357 | 11/1982 | Pollock | 297/445 |

FOREIGN PATENT DOCUMENTS

| | | | |
|---|---|---|---|
| 93842 | 12/1938 | Sweden | 297/419 |

*Primary Examiner*—Francis K. Zugel

*Attorney, Agent, or Firm*—Phillips, Moore Lempio & Finley

[57] ABSTRACT

A seating unit comprises a pair of armrests, a first backrest secured between rearward ends of the armrests and disposed in cantilevered relationship therewith on the seating unit, a second backrest disposed in unattached relationship below the first backrest, and a seat secured in the seating unit between front and rearward sides thereof. The arm and backrests, as well as front and rear legs adapted to be used with the seating unit, are covered with a replaceable and exposed protective covering. The covering is composed of an elastomeric cushioning material, such as foamed neoprene, adapted to absorb impact loads imposed thereon. Each backrest preferably includes a semi-rigid flexible plastic strap adapted to flex and deform to at least substantially conform to the contour of the back of a person resting thereagainst.

14 Claims, 6 Drawing Figures

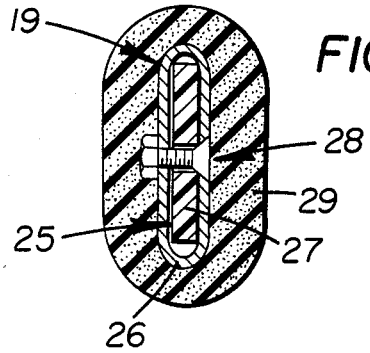
FIGURE 3
FIGURE 2
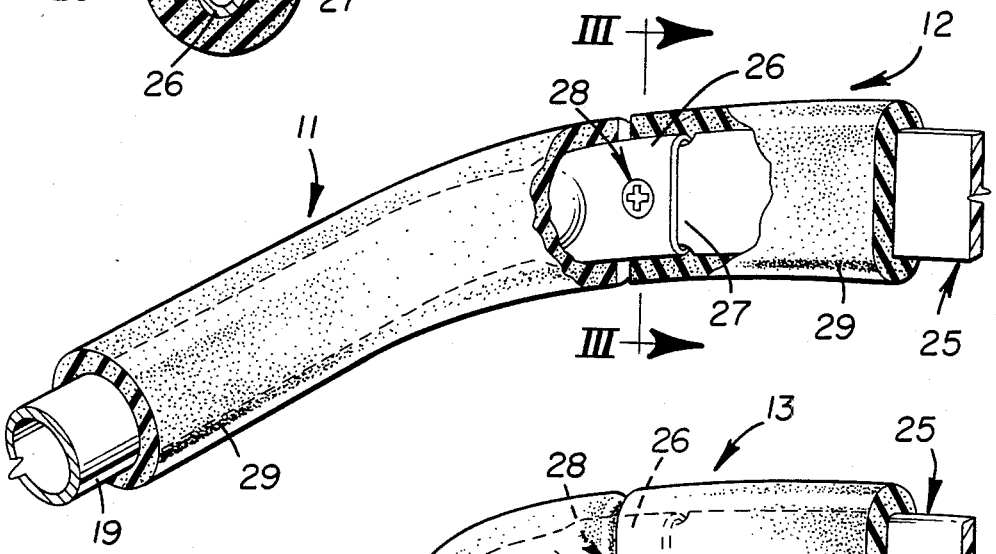
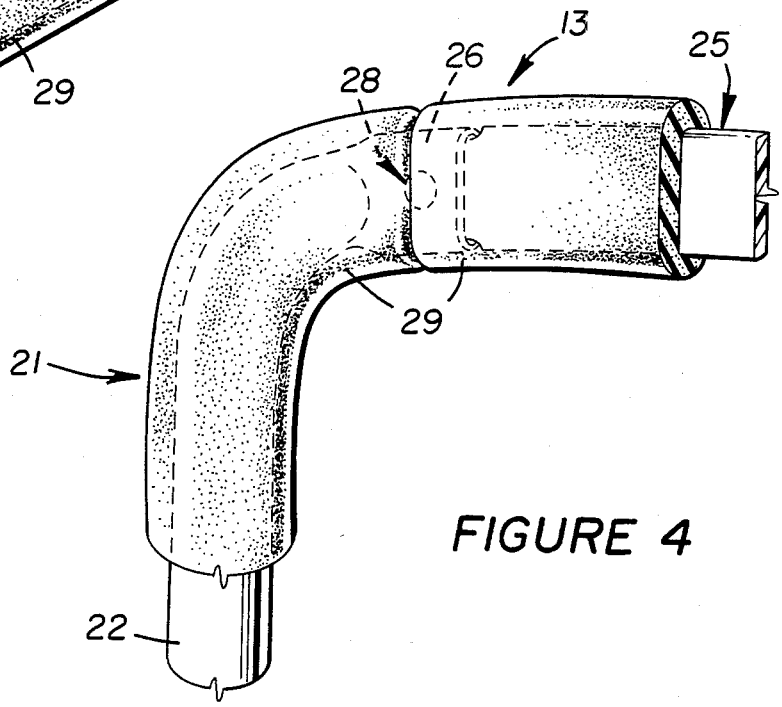
FIGURE 4

FIGURE 5
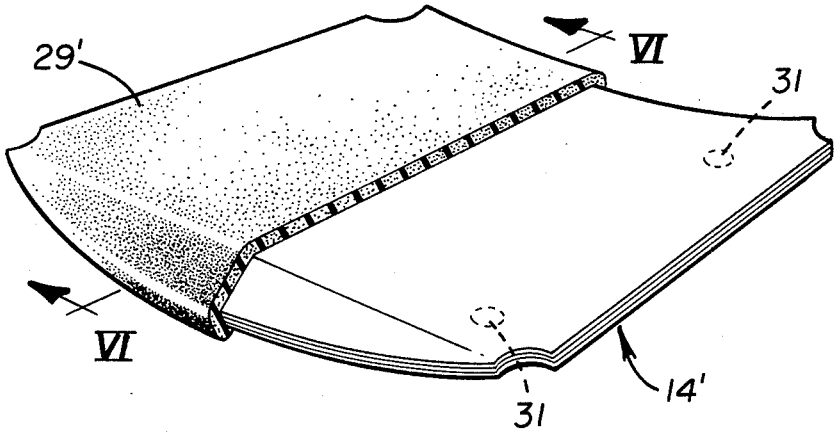
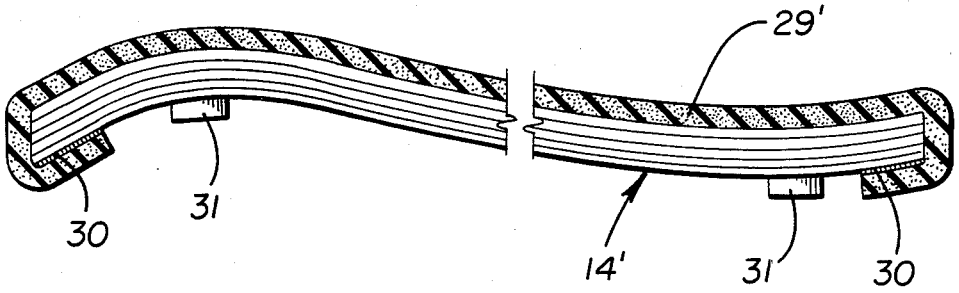
FIGURE 6

FURNITURE CONSTRUCTION WITH REPLACEABLE ELASTOMERIC COVERING

DESCRIPTION

1. Technical Field

This invention relates generally to furniture and more particularly to a replaceable elastomeric covering for components of the furniture and a novel backrest therefor.

2. Background Art

Seating units and other types of furniture used in commercial establishments are subjected to continuous and rigorous use. The covering or upholstery used on chairs, for example, requires periodic replacement due to wear or damage occasioned by such use. The covering, in addition to protecting the frame structure of the chair, should also adapt itself for expeditious installation and replacement. It is further desirable that the covering and composite chair provide a high degree of comfort and a pleasing overall aesthetic appearance.

Conventional coverings for chairs are normally expensive to fabricate, install, and replace, and normally require that the chair be returned to the manufacturer for repair or replacement purposes. Commercial-type chairs of the open frame type give rise to additional problems. In particular, impact loads imposed on these type of chairs can destroy the structural integrity of the chair to render it unfit or unsafe for use. Thus, partial or total replacement of the frame structure would be required. This type of chair, when primarily designed for durability, oftentimes exhibits a relatively uncomfortable or "hard" seating arrangement for the user. In addition, standard commercial seating units include one or more rigid backrests that do not provide the user with back support and comfort level desired.

DISCLOSURE OF THE INVENTION

The present invention overcomes the above, briefly-described problems by providing a furniture construction, particularly adapted for use as a seating unit, comprising a highly durable covering secured over at least one component thereof and adapted to be replaced expeditiously. The cover is composed of an elastomeric cushioning material adapted to absorb impact loads imposed thereon. In one described embodiment of this invention, the elastomeric cushioning material is composed of a foam material having a density in the approximate range of from 5.0 to 35.0 lb./cu.ft. and modulus of elasticity related physical characteristics to exhibit a "spongy" feel.

As described more fully hereinafter, the replaceable covering is particularly adapted for use on a seating unit, such as a chair, to cover one or more components thereof, e.g., legs, armrests, backrests, and/or seat. The covering will thus not only absorb impact loads imposed on the chair to protect the component parts thereof, but also provides a comfortable seating arrangement for the user.

In another aspect of this invention, a seating unit comprises a frame including at least one backrest, with the backrest being composed of a semi-rigid flexible plastic strap adapted to flex and deform to at least generally conform to the contour of the back of a person resting thereagainst. In the preferred embodiment of this seating unit, the backrest has the above-described protective covering secured thereover.

In still another aspect of this invention, a seating unit comprises a pair of laterally-spaced armrests extending from the front to a rearward side of the seating unit, a first backrest secured between rearward ends of the armrests and disposed in cantilevered relationship therewith on the seating arrangement, a second backrest disposed at least approximately vertically below the first backrest and in direct unattached relationship therewith, and a seat secured in said seating unit between the front and rearward sides thereof. In the preferred embodiment of this seating unit, each of the arm and backrests preferably has the above-described covering secured thereover, and each of the backrests includes the further described semi-rigid flexible plastic strap.

BRIEF DESCRIPTION OF THE DRAWINGS

Other objects and advantages of this invention will become apparent from the following description and accompanying drawings wherein:

FIG. 2 is an enlarged partially-sectioned view illustrating a joint connection between an armrest and a first backrest of the chair;

FIG. 3 is an enlarged cross-sectional view through the joint connection, taken in the direction of arrows III—III in FIG. 2;

FIG. 4 is a view similar to FIG. 2, illustrating a similar joint connection between a rear leg and a second backrest of the chair;

FIG. 5 is a partially sectioned isometric view of a seat adapted to be used in the chair and having a protective covering secured thereon; and FIG. 6 is an enlarged longitudinal sectional view through the seat, taken in the direction of arrows VI—VI in FIG. 5.

BEST MODE OF CARRYING OUT THE INVENTION

Figure 1:
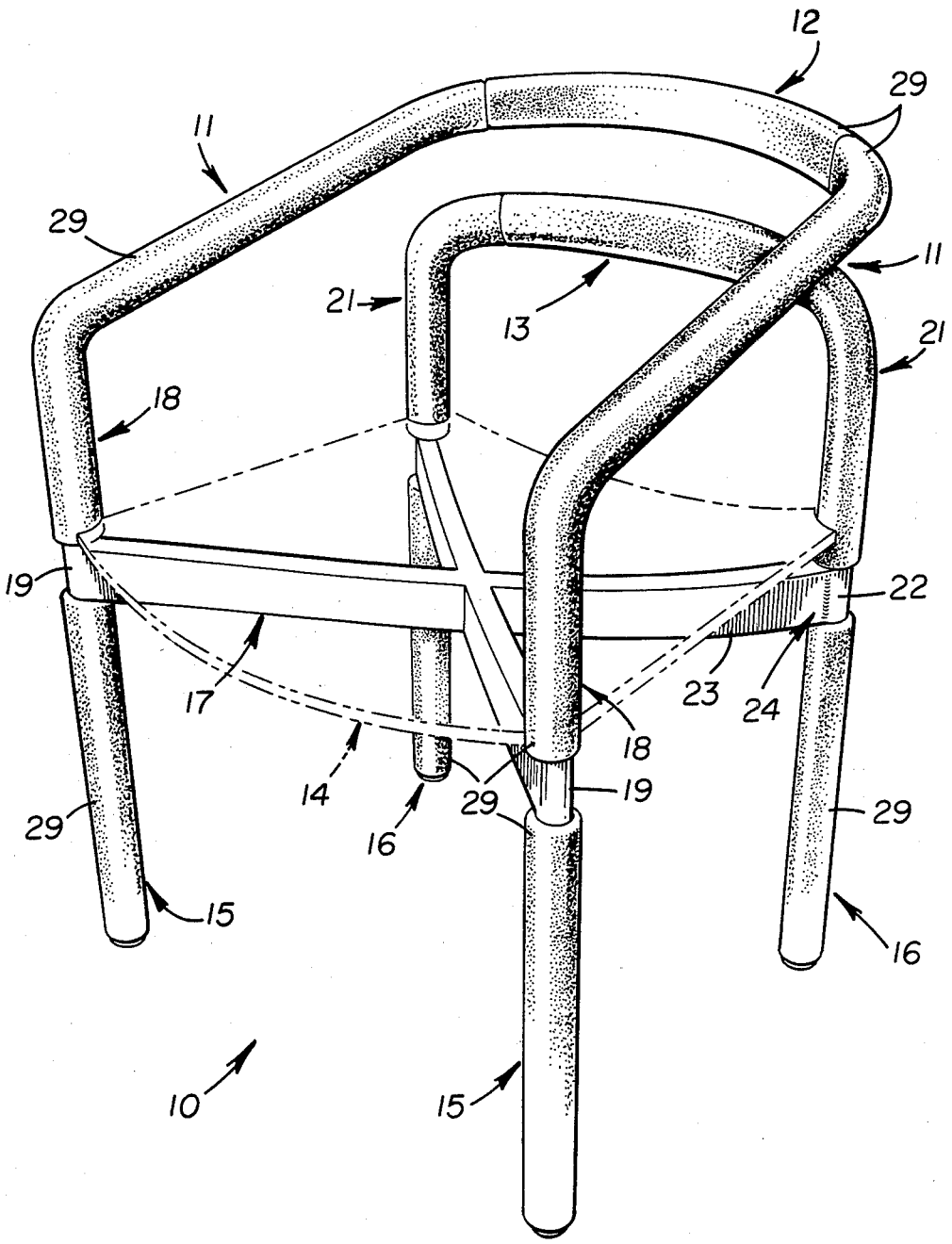
FIG. 1 is a front perspective view of a chair embodying various features of this invention, with a seat thereof shown in phantom-lines to illustrate a support therefor.

FIG. 1 discloses a seating unit 10 in the form of a chair comprising a pair of laterally-spaced armrests 11 extending from the front to the rearward side of the seating unit. At first or upper backrest 12 is secured between rearward ends of the armrests and is disposed in cantilevered relationship therewith on the seating unit. A second or lower backrest 13 is disposed at least approximately vertically below the first backrest and is in direct unattached relationship therewith. A generally horizontally-disposed seat 14, shown in phantom lines, is secured in the seating unit between the front and rearward sides thereof.

Although this generally-described seating unit could be utilized with other types of base supports, the illustrated chair embodiment preferably includes pairs of laterally-spaced and vertically-disposed front and rear legs 15 and 16, respectively, and a cross-shaped seat support 17 secured between the legs to support seat 14 thereon. The seat may take various forms and is releasably secured to seat support 17 by suitably arranged bolts or the like (not shown).

Each front leg 15 is connected to an extension 18 of a respective armrest 11 with the leg, extension, and armrest preferably being formed from a single cold-rolled steel tube 19 which is suitably bent into the configuration illustrated to form a portion of the chair's frame structure. Likewise, each rear leg 16 and a vertical extension 21 of second backrest 13 preferably comprises a one-piece steel tube 22. Each extended member 23 of seat support 17 is welded or otherwise suitably secured at 24 to a respective tube 19 or 22. In a commercial embodiment of the FIG. 1 chair, each steel tube constituted a 16 gauge, 1 in. diameter tubing suitably cut to length and bent, whereas each member of support 17 constituted a 1 in.×2 in.×16 gauge rectangular steel cross-brace.

Referring to FIGS. 2 and 3, backrest 12 comprises a semi-rigid flexible plastic strap 25 secured to each tube 19 at the illustrated type of joint connection. In particular, a flattened end 26 of the tube is suitably swaged to have an oval shape generally conforming internally to the width and thickness of strap 25. A reduced end 27 of the strap is inserted in end 26 of the tube and secured therein by a releasable fastening means 28, more clearly shown in the form of a screw and bolt in FIG. 3. Strap 25 is adapted to flex and deform slightly to at least generally conform to the contour of a back of a person resting thereagainst.

The plastic material composing each strap may comprise polypropylene or a similar material that will exhibit the desired flexural, durability, and related physical characteristics. For example, a polypropylene material, either modified or unmodified, may be composed to have a tensile elastic modulus in the approximate range of from 100,000 to 900,000 psi and a flexural elastic modulus in the approximate range of from 120,000 to 850,000 psi. In a commercial embodiment of the FIG. 1 chair, each polypropylene strap was slightly curved in the vertical plane and had a thickness of 3/16 in. and a width of $1\frac{3}{8}$ in. The strap for backrest 12 had a length approximating $15\frac{1}{4}$ in. between the centers of fasteners 28, whereas the strap for backrest 13 had a corresponding approximate length of $13\frac{1}{4}$ in.

FIG. 4 illustrates a substantially identical joint connection between each tube 22 and a respective end of strap 25 of lower backrest 13.

FIGS. 1–4 further illustrate a replaceable and exposed protective covering 29 that is secured over each armrest 11 and its extensions 18, backrest 12, backrest 13 and its extensions 21, and each front and rear leg 15 and 16. The covering is composed of an elastomeric cushioning material adapted to absorb impact loads imposed thereon. In the preferred embodiment of this invention, such material comprises an elastomer preferably selected from the group consisting of neoprene, polyurethane, polyethylene, styrene-butadiene, polybutadiene, butyl, polyisoprene, nitrile, ethylene-propylene rubbers, and EPDM. The elastomeric material, such as foamed neoprene, is preferably formed in sheet, pad, or tube form and properly dimensioned to retain a spongy characteristic.

In commercial applications under consideration herein, the elastomeric cushioning material preferably has a density in the approximate range of from 5.0 to 35.0 lb./cu.ft. In the commercial chair embodiment illustrated in FIGS. 1–4, tubes of foamed neoprene, having a density approximating 25.0 lb./cu.ft. and cylindrical cross-sections, were suitably cut and inserted over the various components of the chair during assembly. In its relaxed form, each cylindrical tube had an internal diameter of $\frac{7}{8}$ in., an outside diameter of $1\frac{5}{8}$ in., and thus a wall thickness of $\frac{3}{8}$ in. A combined lubricant and adhesive was applied externally on the respective steel tubes, each having an outside diameter of 1 in., prior to insertion of the neoprene tube thereover. The neoprene tube was thus slightly expanded when inserted over a particular steel tube to aid in securing the elastomeric tube in place.

As more clearly shown in FIG. 3, a similarly dimensional cylindrical elastomeric tube was also pulled over each strap 25, which had a perimeter closely approximating the perimeter (e.g., 1 in.) of swaged and flared end 26 of steel tube 19, for example. As further shown in FIG. 2, the elastomeric properties of the covering enabled it to closely conform to any irregularities underlying it to provide a substantially smooth transition between the elastomeric tube secured on strap 25 and the elastomeric tube secured on steel tube 19. Backrest 13 and its attendant components were assembled in a like manner. The frame structure and coverings 29 are preferably finished matte black, but could be otherwise colored.

FIGS. 5 and 6 illustrate application of a similar protective covering 29' on a seat structure 14'. As suggested above, the elastomeric cushioning material composing the protective covering may be fabricated in sheet-form, cut to size, and suitably releasably secured or adhesively bonded to seat structure 14' in a conventional manner. In one commercial application of the seat, coverings 29 was fabricated in sheet form, cut to size, and wrapped around a $\frac{5}{8}$ in. thick plywood seat structure. The formed seat cover was attached around its peripheral edges to the underside of the seat structure by Velcro fasteners 30. Neoprene spacers 31 were adhesively secured between seat support 17 (FIG. 1) and the seat structure with the seat structure being suitably bolted (not shown) to the seat support.

I claim:

1. A seating unit comprising a pair of laterally spaced front legs, a pair of laterally spaced rear legs, a pair of laterally-spaced armrests having forward portions thereof secured directly to upper ends of said front legs, a first horizontally disposed backrest secured directly and solely to said armrests, a second backrest disposed horizontally and at least approximately vertically below said first backrest and being in unattached relationship therewith and secured directly and solely to said rear legs, a seat secured in said seating unit between said front and rear legs, and a replaceable and exposed protective covering secured over at least some of said armrests, backrest, legs, and seat, said covering composed of an elastomeric cushioning material adapted to absorb impact loads imposed thereon.

2. The seating unit of claim 1 wherein said covering is secured over each of said armrests, first and second backrests, and front and rear legs.

3. The seating unit of claim 2 wherein an upper side of said seat is covered with said elastomeric cushioning material.

4. The seating unit of claim 1 wherein said cushioning material at least essentially comprises an elastomer selected from the group consisting of neoprene, polyurethane, polyethylene, styrene-butadiene, polybutadiene, butyl, polyisoprene, nitrile, ethylene-propylene rubbers, and EPDM.

5. The seating unit of claim 3 wherein said cushioning material essentially comprises a foamed material exhibiting a spongy characteristic.

6. The seating unit of claim 1 wherein said elastomeric cushioning material has a density in the approximate range of from 5.0 to 35.0 lb./cu.ft.

7. The seating unit of claim 1 wherein each said first and second backrest comprises a flexible plastic strap for flexing and deforming to at least generally conform to the contour of a back of a person resting thereagainst and said elastomeric cushioning material covers said strap.

8. The seating unit of claim 7 wherein said first backrest is secured between rearward ends of said armrests in cantilevered relationship therewith on said front legs and said second backrest is disposed at least approximately vertically below said first backrest and is secured between upper ends of said rear legs.

9. The seating unit of claim 1 further comprising a cross-shaped seat support having four extending members each secured to a respective one of said front and rear legs, said seat secured on said seat support.

10. A seating unit having front and rearward sides and comprising a pair of laterally spaced and upstanding front legs disposed at the front side of said seating unit, a pair of laterally spaced and upstanding rear legs disposed at the rearward side of said seating unit, a pair of laterally spaced armrests extending from the front to the rearward side of said seating unit and having forward portions thereof secured solely to said front legs, a horizontally disposed first backrest secured solely between rearward ends of said armrests and further disposed in cantilevered relationship therewith on said seating unit, a horizontally disposed second backrest further disposed at least approximately vertically below said first backrest and being in direct unattached relationship therewith, said second backrest having lower portions secured solely to said rear legs, and an at least generally horizontally disposed and cross-shaped seat support having four laterally extending members each secured to a respective one of said front and rear legs.

11. The seating unit of claim 10 further comprising a replaceable and exposed protective covering secured over at least some of said armrests and said first and second backrests, said covering composed of an elastomeric cushioning material adapted to absorb impact loads imposed thereon.

12. The seating unit of claim 11 wherein said covering is secured over each of said armrests and backrests.

13. The seating unit of claim 12 further comprising a seat secured on said seat support and wherein an upper side of said seat is covered with said elastomeric cushioning material.

14. The seating unit of claim 12 wherein each said backrest comprises a flexible plastic strap adapted to flex and deform to at least generally conform to the contour of a back of a person resting thereagainst and said covering covers said strap.

* * * * *